US009072358B2

(12) United States Patent
Han et al.

(10) Patent No.: US 9,072,358 B2
(45) Date of Patent: Jul. 7, 2015

(54) ROTATING AIR DIRECTING APPARATUS FOR A HAIR DRYER

(75) Inventors: Kyusang Han, Port Washington, NY (US); Kyoung Hak Lee, Plainview, NY (US); Won Seok Oh, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 492 days.

(21) Appl. No.: 13/564,267

(22) Filed: Aug. 1, 2012

(65) Prior Publication Data

US 2013/0014402 A1 Jan. 17, 2013

Related U.S. Application Data

(63) Continuation-in-part of application No. 13/088,005, filed on Apr. 15, 2011.

(51) Int. Cl.
*A45D 20/04* (2006.01)
*A45D 20/12* (2006.01)

(52) U.S. Cl.
CPC ..... *A45D 20/124* (2013.01)

(58) Field of Classification Search
CPC ..... A45D 20/00; A45D 20/12; A45D 20/122; A45D 20/124
See application file for complete search history.

(56) References Cited

U.S. PATENT DOCUMENTS

| | | | | |
|---|---|---|---|---|
| 5,054,211 | A | 10/1991 | Shulman | |
| 5,161,317 | A * | 11/1992 | McDougall | 34/97 |
| 5,471,763 | A | 12/1995 | McArthur | |
| 5,473,824 | A | 12/1995 | Prehodka | |
| 5,689,896 | A | 11/1997 | Smetana | |
| 6,011,903 | A | 1/2000 | Nosenchuck | |
| 6,041,514 | A | 3/2000 | Herzog | |
| 6,199,295 | B1 | 3/2001 | Smal et al. | |
| 6,966,125 | B2 | 11/2005 | Rago et al. | |
| 7,178,261 | B2 | 2/2007 | McCambridge et al. | |
| 8,082,679 | B1 | 12/2011 | Amim | |
| 2004/0168337 | A1 | 9/2004 | Curtin | |

FOREIGN PATENT DOCUMENTS

| | | |
|---|---|---|
| JP | 5211915 | 8/1993 |
| JP | 2004176597 | 6/2004 |
| JP | 200675194 | 3/2006 |
| JP | 2010131259 | 6/2010 |

* cited by examiner

*Primary Examiner* — Jiping Lu
(74) *Attorney, Agent, or Firm* — K&L Gates LLP

(57) ABSTRACT

A rotating air directing apparatus for a barrel of a hair dryer is provided. The apparatus includes a tubular adapter member having an inlet opening and an outlet opening. The inlet opening is adapted to be removably coupled to the barrel of the hair dryer. The apparatus also includes a propeller member rotatably coupled to the tubular adapter member. The propeller member includes a plurality of curved vanes extending from a central cylinder. The apparatus further includes a nozzle member disposed adjacent to the outlet opening of the tubular adapter member and adapted to rotate with the propeller member. The nozzle member includes an angled tubular member having a nozzle opening disposed at an acute angle relative to the outlet opening of the tubular adapter member.

10 Claims, 2 Drawing Sheets

ROTATING AIR DIRECTING APPARATUS FOR A HAIR DRYER

CROSS-REFERENCE TO RELATED APPLICATIONS

This application is a Continuation-In-Part Application of U.S. patent application Ser. No. 13/088,005, filed on Apr. 15, 2011, the contents of which are incorporated herein by reference.

BACKGROUND OF THE INVENTION

1. Field of the Invention

The invention relates generally to the field of hair dryers, and more particularly, to devices having a rotating member for directing a circular flow of air from a hair dryer.

2. Description of the Related Art

A number of devices are known that direct air flow from a hair dryer. These devices include nozzle attachments or outlets that spin while deflecting air at an acute angle. The attachments are enabled to spin through the use of internal vanes that are pushed by the air exiting the hair dryer. The vanes are typically connected to and spin around a central point within the attachment. The direction of the air exiting the rotating attachment is thereby constantly changed, sometimes in a circular pattern. However, the air flow exiting from the attachment remains linear by nature, and the vanes only act to change how the linear flow is directed.

SUMMARY OF THE INVENTION

The present invention has been made to address at least the above problems and/or disadvantages and to provide at least the advantages described below. Accordingly, an aspect of the present invention relates to a rotating member for directing a circular flow of air from a portable hand-held hair dryer.

According to one aspect of the present invention, a rotating air directing apparatus for a barrel of a hair dryer is provided. The apparatus includes a tubular adapter member having an inlet opening and an outlet opening. The inlet opening is adapted to be removably coupled to the barrel of the hair dryer. The apparatus also includes a propeller member rotatably coupled to the tubular adapter member. The propeller member includes a plurality of curved vanes extending from a central cylinder. The apparatus further includes a nozzle member disposed adjacent to the outlet opening of the tubular adapter member and adapted to rotate with the propeller member. The nozzle member includes an angled tubular member having a nozzle opening disposed at an acute angle relative to the outlet opening of the tubular adapter member.

BRIEF DESCRIPTION OF THE DRAWINGS

The above and other aspects, features and advantages of the present invention will be apparent from the following detailed description when taken in conjunction with the accompanying drawings, in which.

DETAILED DESCRIPTION EMBODIMENTS OF THE PRESENT INVENTION

Figure 1:
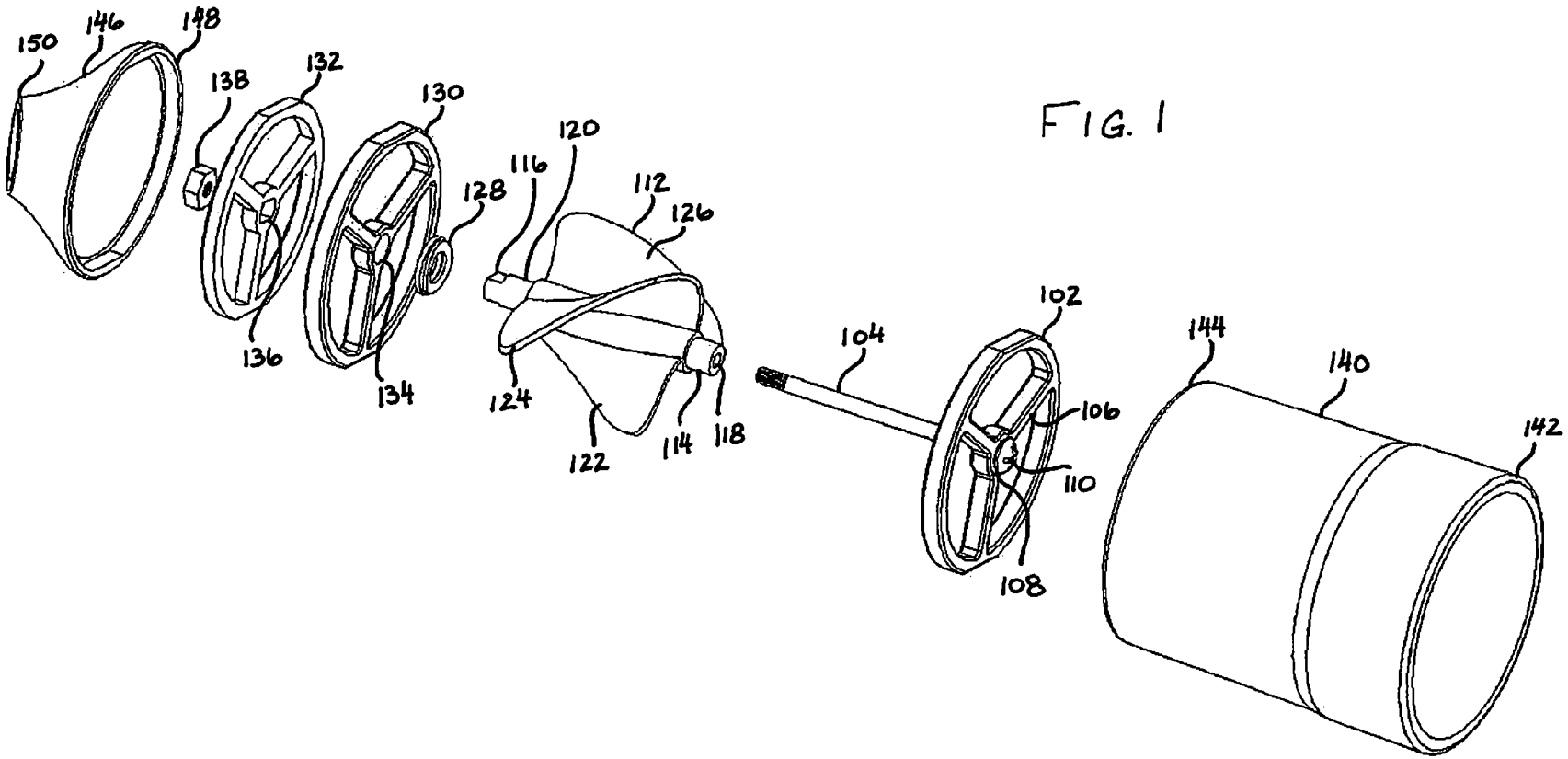
FIG. 1 is a diagram illustrating an exploded perspective view of a rotating air directing apparatus, according to an embodiment of the present invention.

Embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

FIGS. 1-6 show a rotating air directing apparatus for a barrel of a hair dryer, according to embodiments of the present invention. The air directing apparatus may be an attachment adapted to be removably secured to the barrel of a hair dryer, or may be integral with a hair dryer barrel itself. A hair dryer is preferably a handheld portable hair dryer typically used at home or in a salon.

The rotating air directing apparatus is powered by the force of the air flowing from the hair dryer. The apparatus is designed and configured to create a moving, rotating pattern of heated air flow similar to that achieved when an operator manually manipulates the hair dryer relative to the hair to be dried. A rotating air directing apparatus, or a hair dryer assembly, according to an embodiment of the present invention, eliminates the need for the operator to continuously manipulate the hair dryer, thereby reducing operator fatigue.

Referring initially to FIG. 1, a diagram illustrates an exploded perspective view of a rotating air directing apparatus, according to an embodiment of the present invention. The rotating air directing apparatus includes a first stopper 102 that supports a shaft 104. The first stopper includes two or more support members 106 that maintain a central aperture 108 in a central region of the first stopper 102. The shaft 104 extends from the central aperture 108 of the first stopper 102. More specifically, a head 110 of the shaft 104 is wider than the central aperture 108 and is disposed on one side of the central aperture 108, while a main body of the shaft 104 extends perpendicularly away from a face of an opposing side of the central aperture 108. The head 110 of the shaft 104 may be configured so that it can be engaged and rotated by a screwdriver.

The shaft 104 is configured to extend within a propeller member 112 from a proximate end 114 and beyond a distal end 116 of the propeller member 112. More specifically, the shaft 104 extends through an aperture 118 that runs through a central cylinder 120 of the propeller member 112. The propeller member 112 includes a plurality of curved vanes 122, 124 and 126.

The rotating air directing apparatus may include two, three or more vanes. For example, as shown in FIG. 1, a first curved vane 122, a second curved vane 124 and a third curved vane 126 may be disposed on and extend from the central cylinder 120 of the propeller member 112. The curved vanes 122-126 are configured to cause the propeller member 112 to rotate when an air stream from a hair dryer flows past the curved vanes 122-126. The shape and arrangement of the curved vanes 122-126 create a vortex or a whirling mass of air. In particular, the plurality of curved vanes 122-126 include a corresponding plurality of fixed edges at the central cylinder 120. Each fixed edge is associated with a respective one of the curved vanes 122-126.

The plurality of curved vanes 122-126 also include a plurality of free edges. Each free edge is associated with a respective one of the curved vanes 122-126. The free edges are spaced apart from the central cylinder 120 of the propeller member 112.

The plurality of curved vanes 122-126 may also include a plurality of side edges that extend between a respective one of the fixed edges and a respective one of the free edges.

The curved vanes 122-126 are equally spaced apart and define a plurality of curved radial openings between adjacent curved vanes.

A washer 128, a second stopper 130 and a third stopper 132 are disposed over the central cylinder 120 of the propeller member 112. The second stopper 130 is substantially identical to the first stopper 102. More specifically, the central cylinder 120 passes through the washer 128 and the second stopper 130, such that the substantially circular outer periphery of the central cylinder 120 freely rotates within the substantially circular inner periphery of the washer 128 and a central aperture 134 of the second stopper 130.

The distal end 116 of the central cylinder 120 has flattened portions on the top and the bottom. These flattened portions coincide with flattened portions of an inner circumference of a central aperture 136 of the third stopper 132. The third stopper 132 is substantially identical to the first stopper 102 and the second stopper 130 with the exception of these flattened portions. Accordingly, the distal end 116 of the central cylinder 120 extends within the central aperture 136 of the third stopper 132 a distance that the flattened portions allow. Further, the flattened portions of both the distal end 116 and the central aperture 136 enable the third stopper 132 to rotate with the propeller member 112.

A nut 116 engages a distal end of the shaft 104 that extends beyond the central cylinder 120 and the third stopper 132. The distal end of the shaft 104 is grooved for engagement with the nut, and the head 110 of the shaft 104 may be turned by a screwdriver, for example, for assembly. Thus, the nut 116 allows the shaft 104 to run through the first stopper 102, the propeller member 112, the washer 128, the second stopper 130 and the third stopper 132. More specifically, the nut 116 secures the propeller member 112, the washer 128, and the second stopper 130, between the first stopper 102 and the third stopper 132.

The elements of the rotating air directing apparatus including and disposed between the first stopper 102 and the second stopper 130 are disposed within a tubular adapter member 140. The tubular adapter member 140 includes a proximate inlet end 142 and distal outlet end 144. The third stopper 132 is disposed within a nozzle member 146. The nozzle member 146 has an inlet end 148 and an outlet end 150.

The tubular adapter member 140 is adapted to be removably coupled to a barrel of a hair dryer. For example, an internal diameter of the tubular adapter member 140 may be dimensioned to fit over an outer diameter of the hair dryer barrel to provide a press-on or friction fit. Alternatively, an outer diameter of the tubular adapter member 140 may have dimensions that fit within an inner diameter of the hair dryer barrel to provide a press-on or friction fit. Other possible arrangements for providing a removable coupling between the tubular adapter member 140 and the barrel of the hair dryer include an engaging groove on one or both of the tubular adapter member 140 and the barrel of the hair dryer, a threaded fit and a clamping element.

The tubular adapter member 140 may be formed from a rigid, lightweight plastic material or any other suitable material or materials. The tubular adapter member 140 may have an outer diameter in a range between approximately 30 mm and 70 mm, for example, approximately 53 mm, and a length in a range between approximately 40 and 80 mm, for example, approximately 61 mm. However, the tubular adapter member 140 may be any suitable size for coupling to the hair dryer. A length of the tubular adapter member 140 may be in a range of approximately 60 to 100 mm, for example, 82 mm. However, the assembly may be any suitable length for achieving its intended purpose.

The inlet end 148 of the nozzle member 146 is disposed adjacent to the distal outlet opening 144 of the tubular adapter member 140 and is adapted to rotate independent of the tubular adapter member 140. The nozzle member 146 may be rigidly coupled to the propeller member 112 or may be formed integrally therewith to provide a single unitary structure. The nozzle member 146 includes an angled tubular member, which can have, for example, a semi-conical or frusto-conical shape.

The outlet end 150 of the nozzle member 146 is disposed at an acute angle relative to the distal outlet opening 144 of the tubular adapter member 140. Specifically, a imaginary perpendicular line passing through a center of the outlet end 150 of the nozzle member 146 forms an angle of less than ninety degrees with an imaginary perpendicular line passing through a center of the distal outlet opening 144. Due to the configuration of the angled nozzle opening, when the nozzle member 146 rotates, a moving, rotating pattern of heated air flow is created which is similar to that achieved by an operator manually manipulating the hair dryer relative to the hair to be dried. The nozzle member 146 may be formed from a rigid, lightweight plastic material or any other suitable material or materials.

Figure 2:
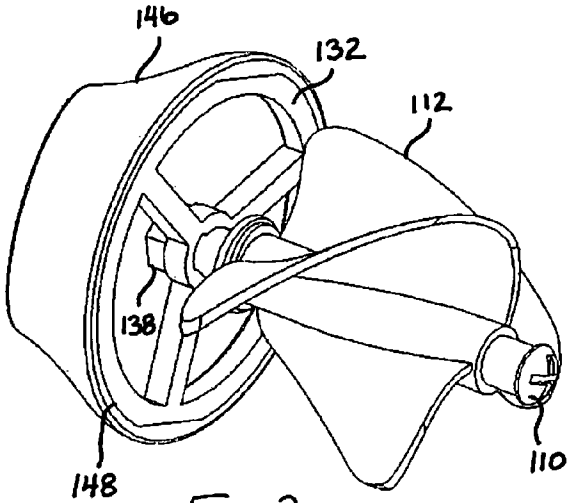
FIG. 2. is a diagram illustrating a perspective view of a first part of the rotating air directing apparatus, according to an embodiment of the present invention.

Referring now to FIG. 2, a diagram illustrates a perspective view of a first part of the rotating air directing apparatus, according to an embodiment of the present invention. The first part of the rotating air directing apparatus includes the propeller member 112, the third stopper 132, and the nozzle member 146. The propeller member 112, the third stopper 132, and the nozzle member 146 all rotate together when air is directed toward the propeller member 112.

The third stopper 132 and the nut 138 are disposed within the nozzle member 146. The third stopper member 132 has a substantially circular periphery with the exception of flattened regions on the top and bottom of the periphery. The periphery of the third stopper member 132 fits within a similarly shaped interior circumference of the nozzle member 146. The flattened portions of both the periphery of the third stopper member 132 and the interior circumference of the nozzle member 146 prevent the third stopper member 132 from rotating within the nozzle member 146, and allow the third stopper 132 member and the nozzle member 146 to rotate together.

As described above with respect to FIG. 1, the distal end 116 of the central cylinder 120 of the propeller member 112 engages the central aperture 136 of the third stopper 132. Due to the flattened regions on the periphery of the distal end 116 and interior circumference of the central aperture 136 of the third stopper 132, the central cylinder 120 is prevented from rotating within the central aperture 136 of the third stopper 132, and the third stopper 132 is allowed to rotate with the propeller member 112. The nut 138 engages a threaded end of the shaft 104 so that the propeller member 112 and the third stopper 132 also remain engaged. As described above, the threaded end of the shaft 104 may be tightened into the nut 138 by engaging the head 110 of the shaft 104 with a screwdriver.

Figure 3:
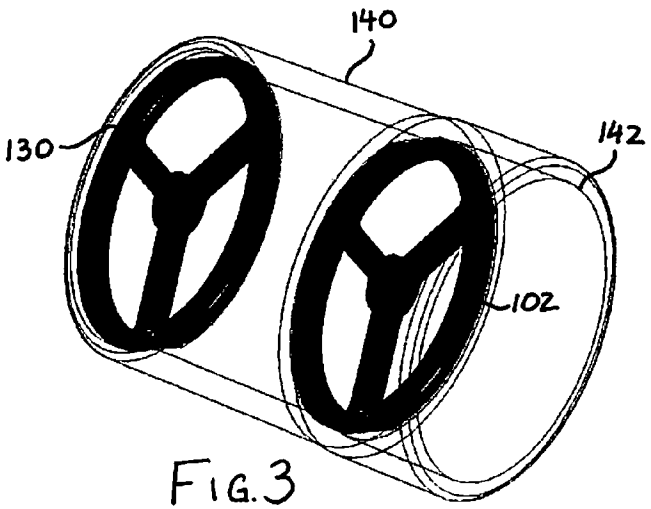
FIG. 3 is a diagram illustrating a perspective view of a second part of the rotating air directing apparatus, according to an embodiment of the present invention.

FIG. 3 is a diagram illustrating a perspective view of a second part of the rotating air directing apparatus, according to an embodiment of the present invention. The second part of the rotating air directing apparatus includes the first stopper 102, the second stopper 130 and the tubular adapter member 140. The first stopper 102 and the second stopper 130 both have substantially circular peripheries with the exception of flattened regions on the top and bottom of the peripheries. The first stopper 102 and the second stopper 130 are disposed at defined areas on the interior of the tubular adapter member 140, where an interior circumference of the tubular adapter member has corresponding flattened portions. Thus, the peripheries of the first stopper 102 and the second stopper 130 fit within similarly shaped interior portions of the tubular adapter member 140. The flattened portions the periphery of the first and second stoppers 102 and 130 and the interior portions of the tubular adapter 140 prevent the first and second stoppers 102 and 130 from rotating within the tubular adapter 140.

Due to the circular shape of the interior periphery of central apertures in the first and second stoppers 102 and 130 and the circular exterior periphery of the central cylinder 120 of the propeller member 112, the central cylinder may rotate within the central apertures of the first and second stoppers 102 and 130. Thus, when first and second parts of the rotating air directing apparatus are assembled, the propeller member 112 is held between the first and second stoppers 102 and 130, and the propeller member 112 can rotate independent of the first and second stoppers 102 and 130.

Figure 4:
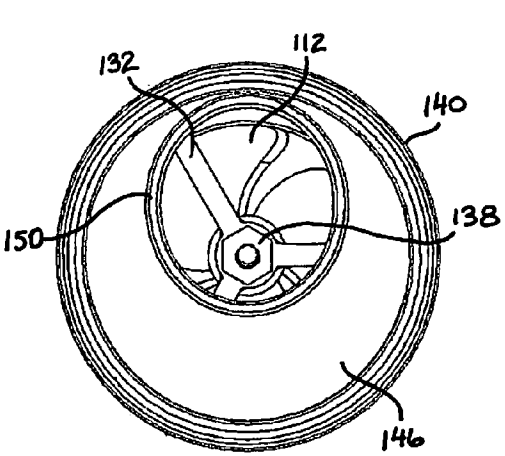
FIG. 4 is a diagram illustrating a front view of the rotating air directing apparatus, according to an embodiment of the invention.

Referring now to FIG. 4, a diagram illustrates a front view of the rotating air directing apparatus, according to an embodiment of the invention. The outlet opening 150 of the nozzle member 146 shows the nut 138, the third stopper 132 and the propeller member 112 within the nozzle member 146 and the tubular adapter 140.

Figure 5:
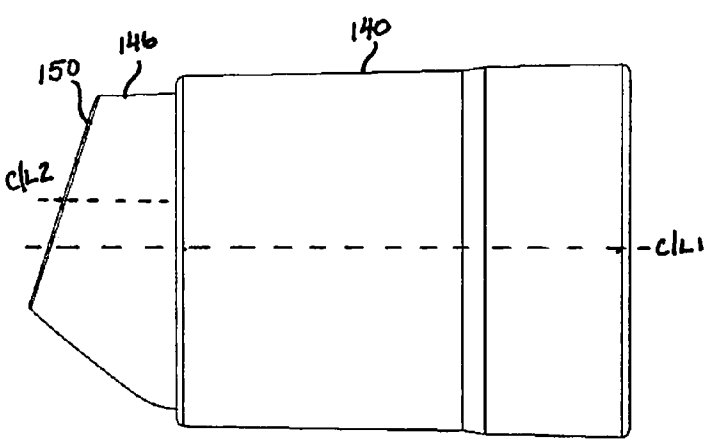
FIG. 5 is a diagram illustrating a side view of the rotating air directing apparatus, according to an embodiment of the present invention.

Referring now to FIG. 5, a diagram illustrates a side view of the rotating air directing apparatus, according to the embodiment of the present invention. The nozzle member 146 is shown having the outlet opening 150, which has an acute angle, and extends only partially across a planar circumference of the nozzle member 146. Specifically, the outlet opening 150 of the nozzle member 146 extends from a first end of the planar circumference outwardly at an acute angle to a point beyond the center of the planar circumference of the nozzle member 146 but not reaching the other end of the planar circumference. The outlet opening 150 is preferably ovular in shape.

A center line C/L1 is drawn through a center of the tubular adapter member 204. In an embodiment of the present invention a lowest point of the outlet opening 150 of the nozzle member 146 is illustrated as 7.3 mm below the center line C/L1, while a center line C/L2 of the opening of the nozzle member 146 is illustrated as 6.3 mm above the center line C/L1.

Figure 6:
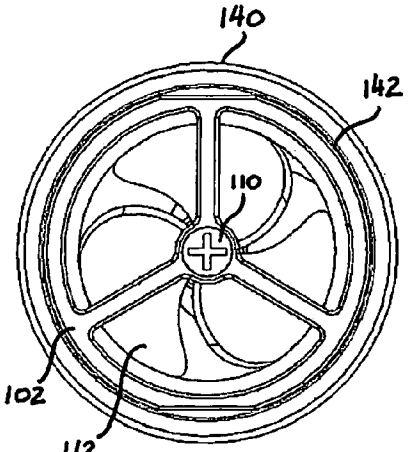
FIG. 6 is a diagram illustrating a rear view of the rotating air directing apparatus, according to an embodiment of the present invention.

FIG. 6 illustrates a back view of the rotating air directing apparatus, according to an embodiment of the present invention. The first stopper 102, the head 110 of the shaft 104, and the propeller member 112 are shown through the inlet opening 142 of the tubular adapter member 140.

While the invention has been shown and described with reference to certain embodiments thereof, it will be understood by those skilled in the art that various changes in form and detail may be made therein without departing from the spirit and scope of the invention as defined by the appended claims.

What is claimed is:

1. A rotating air directing apparatus for a barrel of a hair dryer, the apparatus comprising:

a tubular adapter member having an inlet opening and an outlet opening, wherein the inlet opening is adapted to be removably coupled to the barrel of the hair dryer;

a propeller member rotatably coupled to the tubular adapter member, wherein the propeller member comprises a plurality of curved vanes extending from a central cylinder;

a nozzle member disposed adjacent to the outlet opening of the tubular adapter member and adapted to rotate with the propeller member, wherein the nozzle member comprises an angled tubular member having a nozzle opening disposed at an acute angle relative to the outlet opening of the tubular adapter member;

a first stopper member disposed on an inner surface of the tubular adapter member that rotatably engages the propeller member, the first stopper member being proximate to the inlet opening; and a second stopper member disposed on an inner surface of the tubular adapter member that rotatably engages the propeller member, the second stopper member being proximate to the outlet opening, wherein opposing ends of the central cylinder of the propeller member are rotatably disposed within respective central apertures of the first and second stopper members.

2. The rotating air directing apparatus of claim 1, wherein exterior circumferences of the first and second stoppers and an interior circumference of the tubular adapter member are substantially circular with the exception of at least one flattened portion, and the first and second stoppers remain stationary with the tubular adapter member while the propeller member rotates.

3. The rotating air directing apparatus of claim 1, further comprising a third stopper member disposed on an inner surface of the nozzle member.

4. The rotating air directing apparatus of claim 3, wherein a most distal end of the central cylinder of the propeller member is disposed within a central aperture of the third stopper member.

5. The rotating air directing apparatus of claim 4, wherein an exterior circumference of the most distal end of the central cylinder and an interior circumference of the central aperture of the third stopper member are substantially circular with the exception of at least one flattened portion, and wherein the third stopper member rotates with the propeller member.

6. The rotating air directing apparatus of claim 5, wherein an exterior circumference of the third stopper member and an interior circumference of the nozzle member are substantially circular with the exception of at least one flattened portion, and wherein the nozzle member rotates with the third stopper member and the propeller member.

7. The rotating air directing apparatus of claim 5, further comprising a shaft that extends through an aperture in the central cylinder of the propeller member and maintains the first stopper, the second stopper and the third stopper between opposing ends of the shaft and on the central cylinder.

8. The rotating air directing apparatus of claim 7, wherein the first stopper, the second stopper and the third stopper are maintained between a head and a nut of the shaft.

9. The rotating air directing apparatus of claim 1, wherein the plurality of curved vanes comprises a first curved vane, a second curved vane and a third curved vane.

10. The rotating air directing apparatus of claim 1, wherein the nozzle opening is ovular in shape having a longest diameter that extends from a point linear with a planar circumference of the outlet opening to a point linearly between a center of the outlet opening and an opposing point on the planar circumference of the outlet opening.

* * * * *